US005503441A

United States Patent [19]

Schwaiger

[11] Patent Number: 5,503,441

[45] Date of Patent: Apr. 2, 1996

[54] DOUBLE LOCKING LOCK ACTUATOR

[75] Inventor: Dennis D. Schwaiger, Whitmore Lake, Mich.

[73] Assignee: Stoneridge, Inc., Warren, Ohio

[21] Appl. No.: 130,061

[22] Filed: Sep. 30, 1993

[51] Int. Cl.[6] ..... E05B 77/00; E05C 13/00

[52] U.S. Cl. ..... 292/3363; 292/DIG. 65; 292/144; 292/142; 292/DIG. 23; 70/434; 70/280; 70/283

[58] Field of Search ..... 292/201, 336.3, 292/DIG. 65, DIG. 23, DIG. 24, DIG. 27, 144, 216, 160, 172, 142; 70/264, 280, 283, 434

[56] References Cited

U.S. PATENT DOCUMENTS

| | | | |
|---|---|---|---|
| 3,566,703 | 3/1968 | Van Noord . | |
| 4,093,289 | 6/1978 | Inabayashi et al. | 292/336.3 |
| 4,135,377 | 1/1979 | Kleefeldt et al. | 292/201 |
| 4,342,209 | 8/1982 | Kleefeldt | 70/264 |
| 4,364,249 | 12/1982 | Kleefeldt | 292/201 |
| 4,384,465 | 5/1983 | Muus | 292/172 |
| 4,559,796 | 12/1985 | De Forrest, Sr. | 70/434 |
| 4,573,723 | 3/1986 | Morita et al. | 292/336.3 |
| 4,674,781 | 6/1987 | Reece et al. | 292/336.3 |
| 4,706,512 | 11/1987 | McKernon et al. | 292/336.3 |
| 4,708,378 | 11/1987 | Ingenhoven | 292/201 |
| 4,806,712 | 2/1989 | Hoffman et al. . | |
| 4,893,704 | 1/1990 | Fry et al. | 292/DIG. 62 |
| 4,904,006 | 2/1990 | Hayakawa et al. | 292/DIG. 24 |
| 4,911,488 | 3/1990 | Brackmann et al. | 70/434 |
| 4,974,886 | 12/1990 | Kleefeldt et al. | 70/264 |
| 4,995,658 | 2/1991 | Shiraki et al. | 292/336.3 |
| 5,066,054 | 11/1991 | Ingenhoven | 292/201 |
| 5,078,436 | 1/1992 | Kleefeldt | 70/264 |
| 5,114,197 | 5/1992 | Persiani | 292/336.3 |
| 5,332,273 | 7/1994 | Komachi | 292/336.3 |
| 5,338,076 | 8/1994 | Tanaka | 292/201 |

OTHER PUBLICATIONS

Drawing: General Motors "Switch & Actu–M/Func SW & PWR LK–Mini Wedge Door Lock" Dated Jun. 21, 1988 (Part No. 16626102).

*Primary Examiner*—Darnell M. Boucher
*Attorney, Agent, or Firm*—MacMillan, Sobanski & Todd

[57] ABSTRACT

An improved structure for an actuator for the lock mechanism of a latch assembly, such as a vehicle door latch assembly. The actuator includes a housing having an output arm moveable relative thereto between a lock position and an unlock position, to lock and unlock, respectively, the latch mechanism. An output gear having a pawl formed thereon is rotatably mounted adjacent the output arm. The output gear is adapted to rotate about an axis to cause the pawl to engage a first one of the pair of drive surfaces to urge the output arm toward the lock position. The output gear may be rotated in a second direction to cause the pawl to engage the other of the pair of drive surfaces to urge the output arm toward the unlock position. The output arm is coupled to a blocking member adapted for movement relative thereto. The blocking member may be moved to a blocking position when the output arm is in the lock position. In the blocking position, the blocking member is adapted to engage the housing to prevent the output arm from moving from the lock position. A cam fixed to the output gear is adapted to urge the blocking member into the blocking position when the output gear is rotated into a double lock position. Additionally, the actuator incorporates switches for both latch mechanism position indication and lock mechanism position indication in a single assembly.

19 Claims, 8 Drawing Sheets

CONDUCTOR
150
151
152
N
L
D
U
X
X
X

DOUBLE LOCKING LOCK ACTUATOR

BACKGROUND OF THE INVENTION

This invention relates in general to electrically actuated latch assemblies and, in particular, to an improved structure for an actuator providing a double locking feature for a latch assembly. Such a latch assembly may be used, for example, on a vehicle door.

Vehicles such as passenger cars are commonly equipped with individual latches which secure respective passenger and driver doors. Each latch is typically provided with an individual mechanical lock which may be key operated from the exterior of the vehicle and provided with manual means for operating inside the vehicle, e.g., a respective sill button.

As is commonly known, the lock may be actuated to lock the door and prevent unlatching of the door. An occupant of a vehicle may lock the doors, for example, to prevent entry into the vehicle by an unauthorized individual while the vehicle is momentarially at rest. The terms "latching" and "unlatching" as used herein refer to the acts of, respectively, securing a door closed and freeing the door so it can be opened. "Locking" and "unlocking" are used to refer to the act of actuating a lock mechanism to respectively prevent and permit unlatching of the door.

These locks are commonly provided with a means for remote operation, such as an electrically operated lock actuator for locking and unlocking. It has also been found desirable to provide these locks with a so-called anti-theft or double lock feature. When activated, such a feature disables the interior manual operating means for the lock. The exterior operating means requires a key to be operated, and the electric operating means may be tied into an electronic vehicle security system to prevent unauthorized operation. In this condition, a thief who gains entry into the vehicle by, for example, breaking a window cannot unlock the vehicle door. A vehicle thus equipped is therefore a less attractive target for thieves.

SUMMARY OF THE INVENTION

This invention relates to an improved structure for an actuator for the lock mechanism of a vehicle door latch assembly. The actuator includes an output arm adapted to move axially relative to a housing between a lock position and an unlock position, to lock and unlock, respectively, the latch mechanism. The output arm includes a pair of spaced apart drive surfaces. An output gear having a pawl formed thereon is rotatably mounted on the housing. The output gear is adapted to rotate about an axis to cause the pawl to engage a first one of the pair of drive surfaces to urge the output arm toward the lock position. The output gear may be rotated in a second direction to cause the pawl to engage the other of the pair of drive surfaces to urge the output arm toward the unlock position. The output arm is coupled to a blocking member adapted for movement relative thereto. The blocking member may be moved to a blocking position when the output arm is in the lock position. In the blocking position, the blocking member is adapted to engage the housing to prevent the output arm from moving out of the lock position. A cam fixed to the output gear is adapted to urge the blocking member into the blocking position when the output gear is rotated into a double lock position. Additionally, the actuator incorporates switches for both latch mechanism position indication and lock mechanism position indication in a single assembly.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
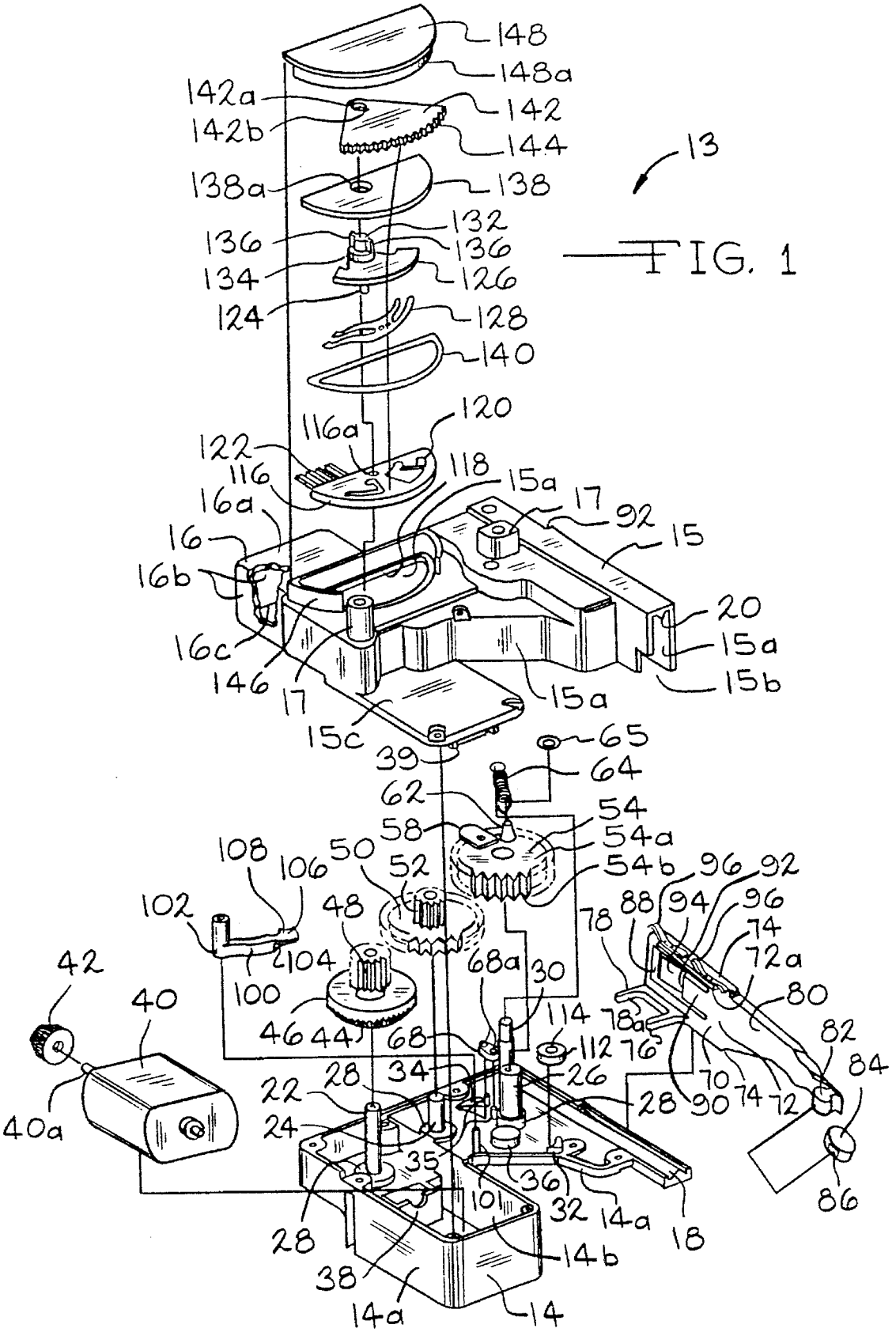
FIG. 1 is an exploded perspective view of a preferred embodiment of the lock actuator.

In the following description of the invention, certain terms will be utilized for the purpose of reference only and are not intended to be limiting. The terms "upward", "downward", "above", "below", "rightward", "leftward", "clockwise", and "counterclockwise" refer to directions in the drawings to which reference is made. The terms "inward" and "outward", refer to directions toward and away from, respectively, the geometric center of the device described. Such terminology will include the words specifically mentioned above, derivatives thereof, and words of similar import.

Referring now to the drawings, there is illustrated in FIG. 1 a lock actuator, indicated generally at 13, which includes an actuator housing comprising a base 14 and a cover 15. The base 14 and the cover 15 may be formed of materials such as a suitable metal or, preferably, a suitable polymeric material. As additionally seen in FIG. 2, the base 14 is provided with an edgewall **14*a* about the perimeter thereof. Along a portion of the perimeter of the base 14, the edgewall 14*a* is relatively short, extending upwardly therefrom. Along a second portion of the base 14, the edgewall 14*a* extends downwardly to form a stepped pocket 14*b***.

Figure 12:
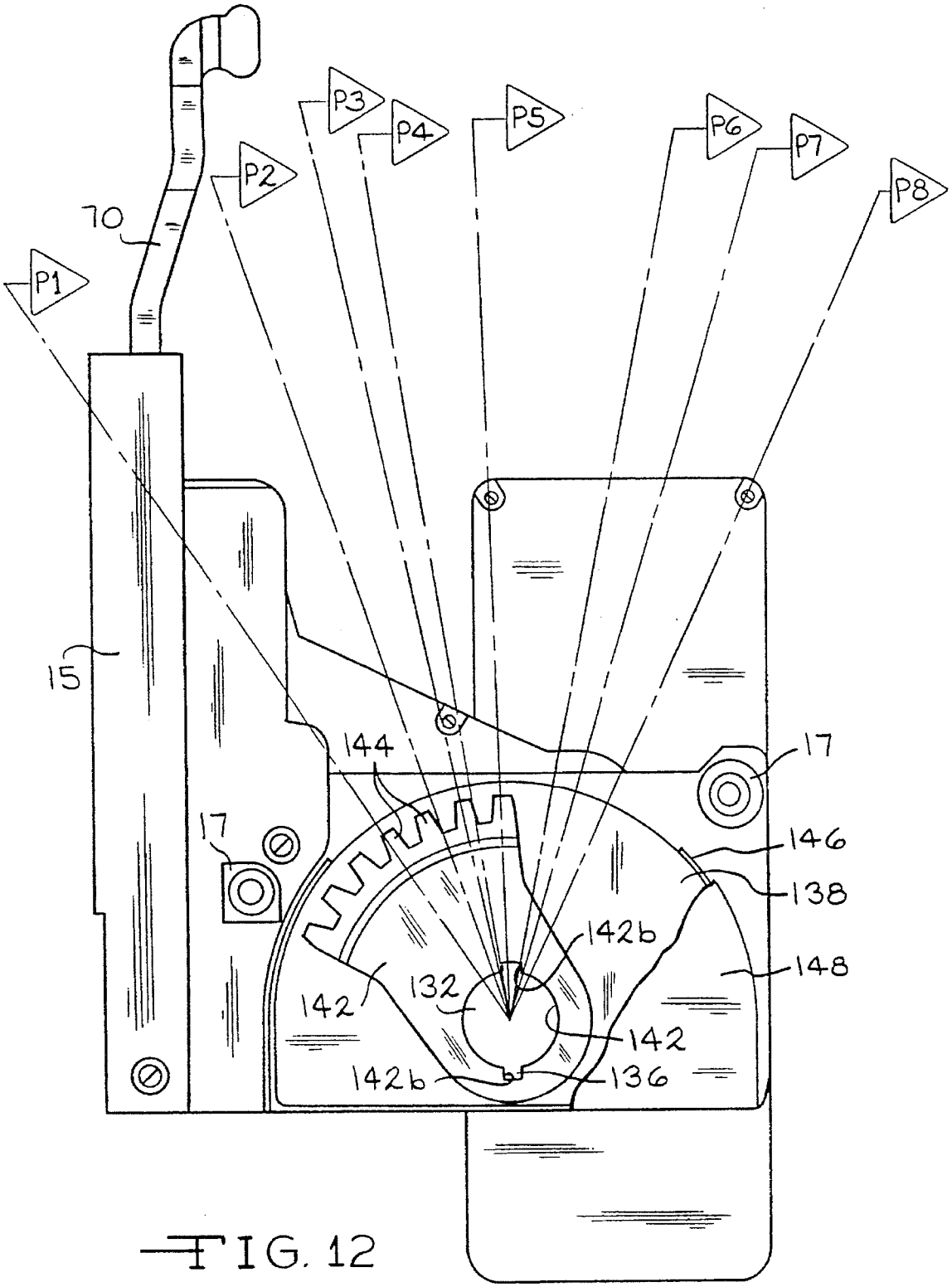
FIG. 12 is an enlarged plan view of the lock actuator of FIG. 1, partly broken away to illustrate the movement of the segment gear.

The cover 15 mates with the base 14 and is secured thereto by conventional means, such as threaded fasteners (seen in FIG. 12). The cover 15 is provided with a downwardly extending edgewall **15*a* about the perimeter thereof, with two exceptions. The first exception is a break in the edgewall 15***a* forming an opening 15*b*. The second portion of the cover 15 without a downwardly extending edgewall is a plate 15*c* which extends radially outwardly from the bottom of the edgewall 15*b* to cover a portion of the pocket 14*b*. The cover 15 is additionally formed with two upwardly extending mounting bosses 17. Each mounting boss 17 has an aperture formed therein which is adapted to receive a threaded fastener (not shown) to mount the lock actuator 13 to a latch assembly (not shown).

A connector cover 16 extends outwardly from the cover 15 opposite from the plate 15*c*. The connector cover 16 includes an upper surface 16*a* and a downwardly extending edgewall 16*b* which cooperate with the edgewall 15*a* to define an interior portion. The base 14 does not have a corresponding outwardly extending portion below the connector cover 16. Thus, the edgewalls 15*a* and 16*b* cooperate to define an opening 16*c* into the interior portion of the connector cover 16 (seen through the broken-away portion of the connector cover 16 in FIG. 1). The purpose of the connector cover 16 will be discussed below.

A dihedral guide track 18 is formed on the base 14, and a second dihedral guide track 20 is formed on the cover 15, parallel to the first track 18. With the base 14 and the cover 15 assembled, one end of each of the guide tracks 18 and 20 terminates at the opening 15*b*. The purpose of the guide tracks 18 and 20 will be discussed below.

First, second, and third cylindrical gear pins 22, 24, and 26, respectively, extend upwardly from respective raised bearing pads 28 formed on the base 14, the pins extending perpendicular to the base 14. A stepped centering spring mounting post 30 also extends perpendicular to the base 14. The upper ends of the gear pins 22, 24, and 26, and the mounting post 30 are supported in respective mounting collars (not shown) formed on the lower surface of the cover 15.

Also formed in the base 14, spaced apart from the third gear pin 26, is a first arcuate backing wall 32. A second arcuate backing wall 34 is disposed generally on the opposite side of the third gear pin 26 from the first backing wall 32. A pair of mounting pins 35 are formed on the base 14, slightly clockwise from the second backing wall 34. The purposes of the backing walls 32 and 34, and the pins 35 will be explained below. A stop block 36 is disposed generally between the third gear pin and the first backing wall 32, the purpose of which will also be discussed later. Finally, motor chocks 38 (best seen in FIG. 2) are molded into the base 14 to mount an electric motor 40 in the pocket 14*b*. Mating chocks 35 depend from the plate 15*c* of the cover 15 (only one of which is visible in FIG. 1) to prevent the motor from shifting upwardly out of the chocks 38.

It will be appreciated by those of ordinary skill in the art that various ones of the above components described as being formed or molded on the base 14 may be alternatively formed separately and secured to the base 14 by conventional means such as mechanical fasteners. Additionally, selected ones of said components, such as the gear pins 22, 24 and 26 may be formed of another material, such as a metal, and fixed to the base 14 as described above.

The electric motor 40 is preferably a Permanent Magnet Direct Current (PMDC) motor. One PMDC motor which has found to be suitable is the model NF223G motor manufactured and available commercially from Johnson Electric North America, Inc., of Fairfield, Conn. Electrical connectors 40*a* on the motor 40 permit the motor to be connected to the control circuit illustrated in FIG. 10. A drive gear 42 is mounted on and driven by the shaft of the electric motor 40. The drive gear 42 is a face gear and engages gear teeth 44 formed on a lower face of a first pinion gear 46. The first pinion gear 46 is rotatably mounted on the first gear pin 22. A reduced diameter gear portion 48 is formed on the upper surface of the first pinion gear 46 and engages a second pinion gear 50. The second pinion gear 50 is rotatably mounted on the second gear pin 24 and includes a larger diameter gear portion meshed with the first pinion gear 46. The second pinion gear 50 further includes a reduced diameter gear portion 52 formed on the upper portion thereof. The gear train thus described between the drive gear 42 and the second pinion gear 50 is arranged to provide conventional amplification of the torque of the motor 40, and forms no part of this invention.

Figure 3:
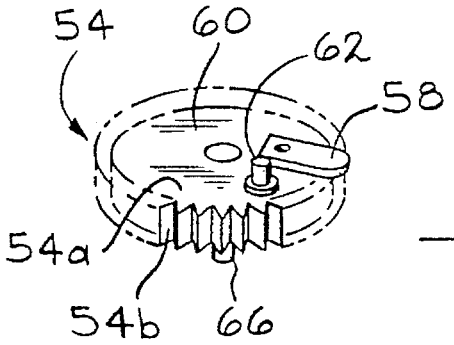
FIG. 3 is an enlarged perspective view of an output gear illustrated in FIG. 1.

An output gear 54, best seen in FIG. 3, has a planar upper surface 54*a*, a lower surface (not shown) parallel to the upper surface 54*a*, and an edgewall 54*b* extending therebetween. The edgewall 54*b* is formed into gear teeth which mesh with the reduced diameter gear portion 52 of the second pinion gear 50. A cam 58 is formed on the upper surface 54*a* of the output gear 54 and extends radially outwardly beyond the edgewall 54*b*, the free end of the cam 58 being formed into a rounded cam surface. The gears in the gear train, including the output gear 54, may be formed of any suitable material such as metal or, preferably, molded of suitable polymeric materials.

Figure 4:
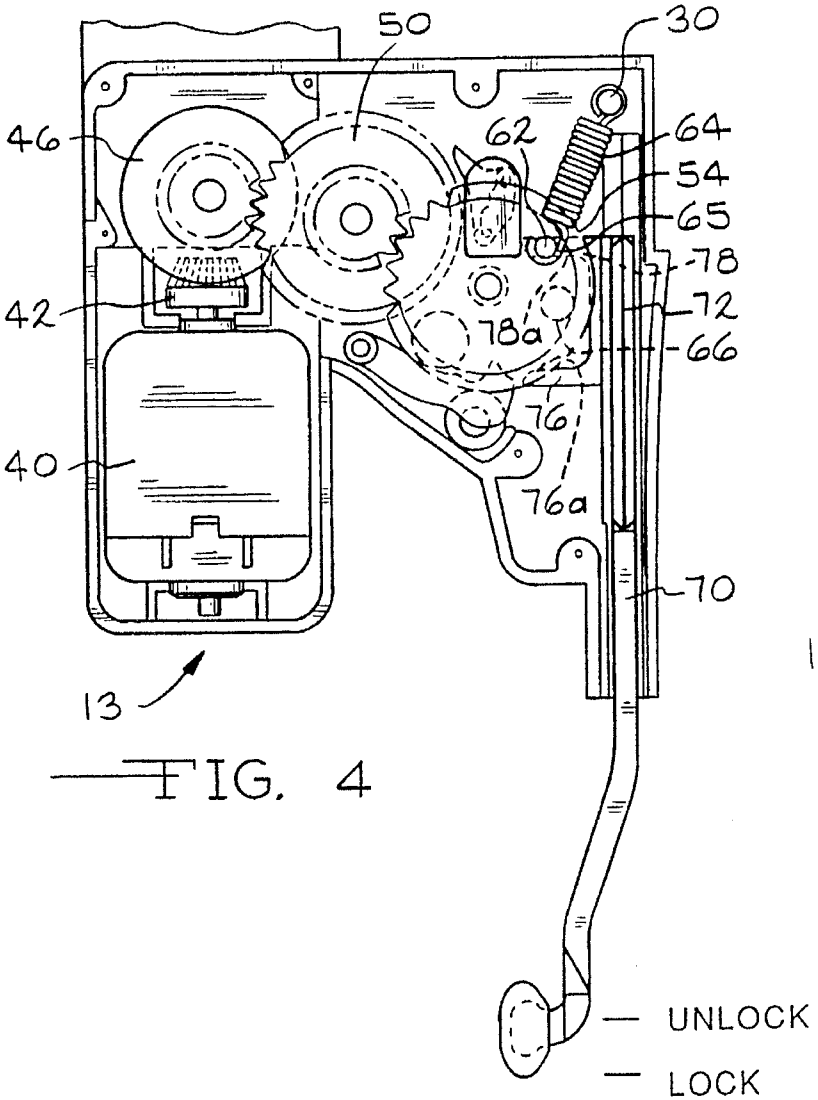
FIG. 4 is a view similar to that of FIG. 2, with the lock actuator gears installed and the lock actuator in a neutral position.

Adjacent the cam 58 in a clockwise direction, a spring mounting pin 62 is fixed to the gear 54. The mounting pin 62 extends upwardly, perpendicular to the upper surface 54*a*. In a preferred embodiment, the mounting pin 62 is formed integrally with the output gear 54 when the gear 54 is molded. A tension extension centering spring 64 is provided with loops at the ends thereof which respectively encircle the mounting pin 62 and the mounting post 30 provided on the base 14. A spring retainer 65 is placed over the free end of the mounting pin 62 (as seen in FIG. 4), thus capturing the respective loop of the spring 64 against the stepped portion of the mounting pin 62. The spring retainer is suitably secured on the free end of the mounting pin 62. In the preferred embodiment, the free end of the mounting pin 62 is heat staked, that is, heated and deformed to provide an enlarged head which secures the spring retainer 65 on the free end of the mounting pin 62. As indicated above, the upper end of the mounting post 30 is received in a mounting collar formed on the lower surface of the cover 14. This secures the centering spring 64 on the mounting post 30.

The centering spring 64 is sized so as to be under tension at all times, and thus urges the output gear 54 to rotate to a neutral position (illustrated in FIG. 4) where the centering spring 64 is in its most relaxed state. In this neutral position the distance between the mounting pin 62 and the mounting post 30 is at a minimum. The purpose of urging the output gear 54 toward this neutral position will be explained below.

Illustrated in FIG. 3 is a pin or pawl 66 formed on the output gear 54. The pawl 66 extends perpendicularly to the lower surface of the output gear 54. It will be appreciated that as the output gear 54 is rotated, the pawl 66 will be moved through an arc.

Figure 5:
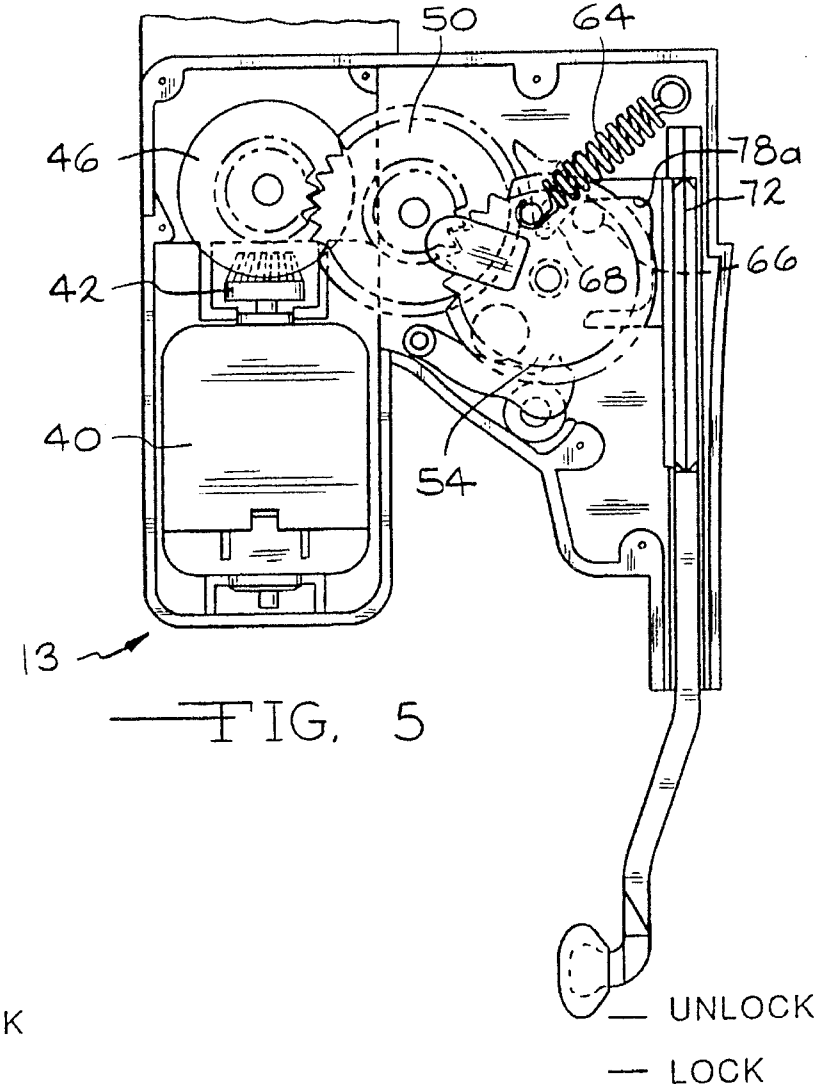
FIG. 5 is a view similar to that of FIG. 4, except illustrating the lock actuator in an unlock position.

The arc through which the pawl 66 is moved is limited in both the clockwise and counter clockwise directions. An unlock bumper 68 is secured abutting the second backing wall 34. The unlock bumper 68 is formed of an elastomeric material and is provided with a pair of bores 68*a* passing therethrough. The two mounting pins 35 pass upwardly through respective ones of the bores 68*a*. The free end of each pin 35 is heat staked to secure the unlock bumper 68 in place on the pins 35. The unlock bumper 68 is adapted to be compressed between the pawl 66 and the second backing wall 34 when the output gear 54 is rotated counterclockwise from its neutral position to an unlock position (as illustrated in FIG. 5). The second backing wall 34 thus provides lateral support for the compressed unlock bumper 68.

Figures 8, 9:
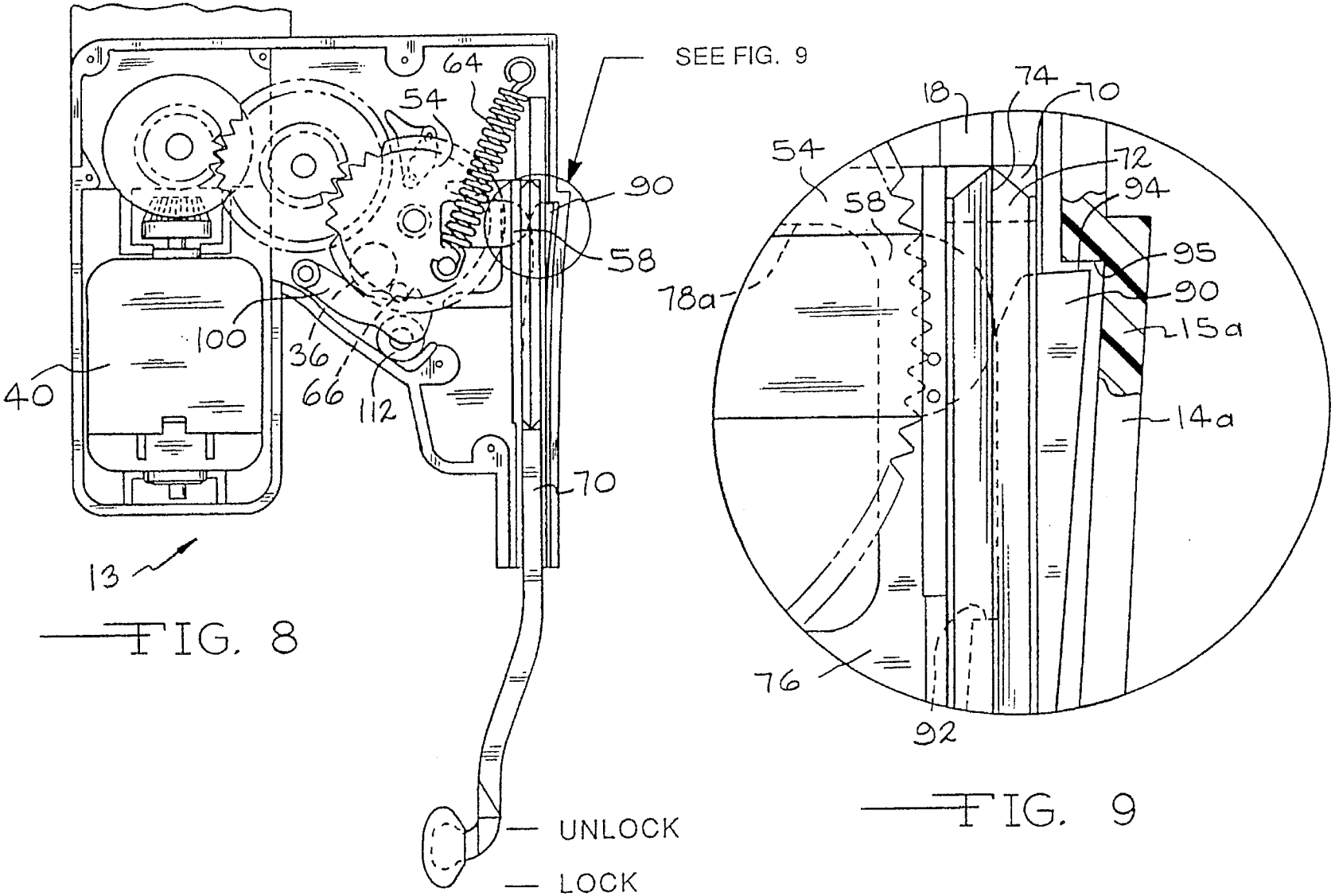
FIG. 8 is a view similar to that of FIG. 4, except illustrating the lock actuator in a double lock position.
FIG. 9 is an enlarged view of the detail indicated at A in FIG. 8, and further including a broken away portion of the edgewall of the cover mounted to the base.

The output gear 54 may also be rotated clockwise from its neutral position. At the extreme clockwise limit of rotation of the output gear 54, the pawl 66 abuts the stop block 36 formed on the base 14, as seen in FIG. 8. When the pawl 66 is in this position, the output gear 54 is in its double lock position, as will be further explained below.

The pawl 66 is disposed to operatively engage an output arm 70. The output arm 70 is provided with a flat rectangular body 72. The body 72 is provided with a flange **72*a* which extends laterally outward from the body 72 along one side thereof. The purpose of the flange 72*a* will be explained below. The body 72 is additionally provided with a pair of convex v-shaped grooves 74 formed in each of the top and bottom edges thereof. The upper groove 74 engages the guide track 20 formed on the cover 15, and the lower groove 74 engages the guide track 18 formed on the base 14. The output arm 70 is thereby guided for sliding reciprocal movement along the guide tracks 18 and 20, the guide tracks 18 and 20 supporting the output arm 70** therebetween.

A pair of spaced apart, substantially parallel fingers 76 and 78 extend laterally outward from the body 72 and generally below the output gear 54. The opposed inner surfaces of the fingers 76 and 78 form a pair of drive surfaces **76*a* and 78*a*, respectively, adapted to be engaged by the pawl 66. It will be noted that the drive surfaces 76*a* and 78*a* are spaced apart a distance which is greater than the diameter of the pawl 66. As will be explained in more detail below, the pawl 66 thereby cooperates with the drive surfaces 76*a* and 78*a* to provide a lost motion connection between the output gear 54 and the output arm 70**.

Figure 2:
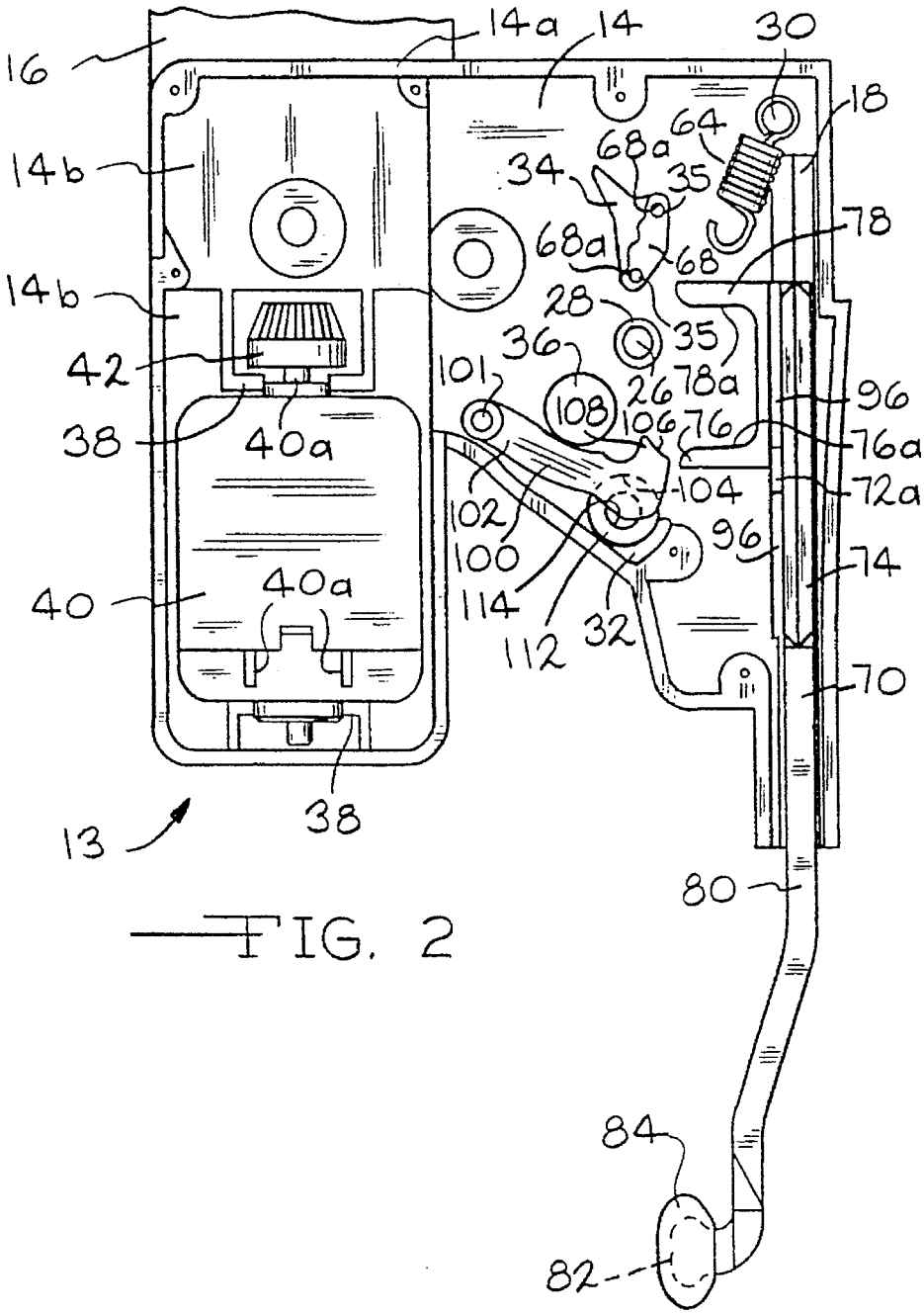
FIG. 2 is an enlarged plan view of the lock actuator of FIG. 1 illustrated with the lock actuator partially assembled.

Extending axially outward from the body 72 is a tapered extension 80, having an outline (as seen in FIG. 2) similar to a backwards "L". The extension 80 extends outside of the housing formed by the base 14 and the cover 15 through the opening **15*a*. The tip of the extension 80 terminates in an ovaloid portion 82**.

A conventional elastomeric isolator 84, having a concavity 86 formed therein, is fitted over the connector portion 82 so that the ovaloid portion 82 is received in the concavity 86. The exterior surface of the isolator 84 is adapted to be engaged by a corresponding female connector portion of a lock mechanism of the latch assembly (not shown). Reciprocation of the output arm 70 to a retracted or unlock position (illustrated in FIG. 5) operates, via the connector portion 82 and isolator 84, to cause the lock mechanism to unlock the latch assembly. Similarly, movement of the output arm 70 to an extended or lock position (illustrated in FIGS. 6, 7, and 8) causes the lock mechanism to lock the latch assembly.

A generally C-shaped slot 88 extends through the body 72 of the output arm, thereby integrally forming a flexible blocking member 90 in the output arm 70. The blocking member 90 is fixed at one end to the body 72. An angled notch 92 (best seen in FIG. 9) formed in the blocking member 90 increases the ease by which a free end 94 of the blocking member 90 may be bent out of the plane of the body 72. The output arm 70 is formed of a suitable resilient material, preferably a polymeric matrial such as nylon, such that when the free end 94 is flexed outwardly into a blocking position and released, the blocking member 90 will return to the plane of the body 92. A previously known type of blocking member is provided with a pin upon which the blocking member is rotatably mounted and a seperate spring for returning the blocking member from a blocking position. Thus the previously known blocking members are more complex and expensive to manufacture than the blocking member 90.

Figure 6:
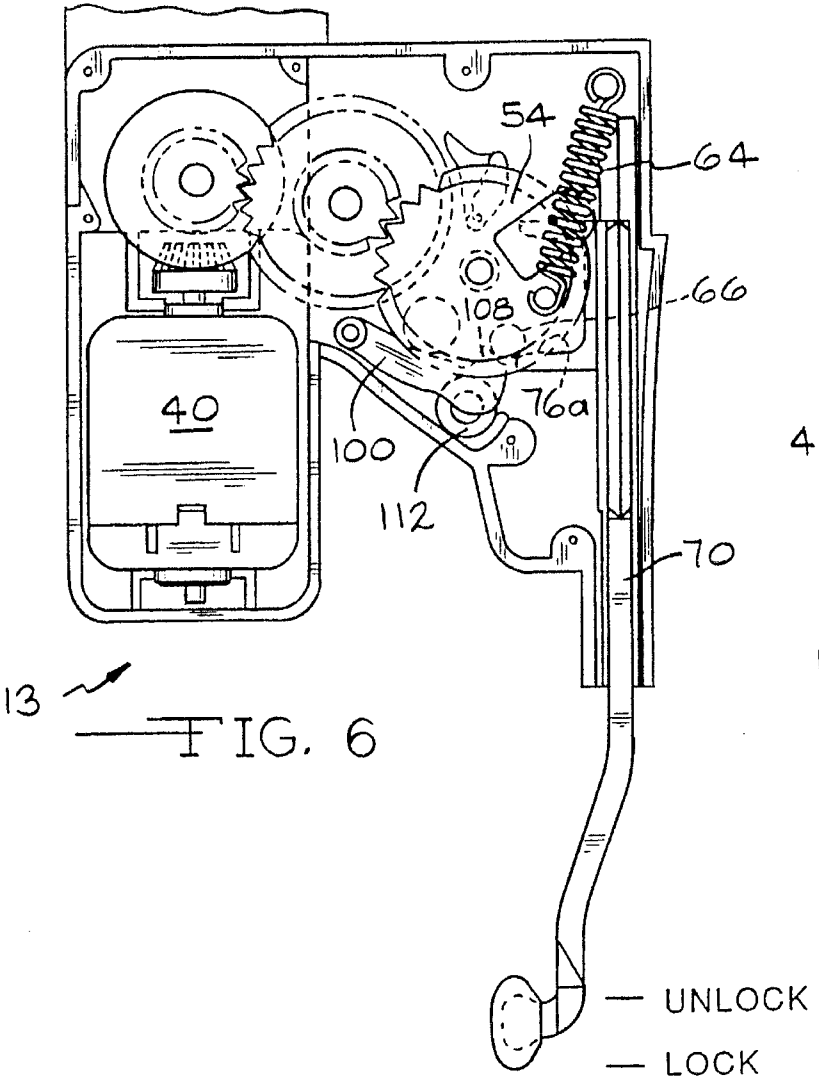
FIG. 6 is a view similar to that of FIG. 4, except illustrating the lock actuator in a lock position.

When the output arm 70 is extended to the lock position as illustrated in FIG. 6, the free end 94 may be bent outwardly to the blocking position, engaging a bend or notch 95 formed in the edgewall **15*a* of the cover 15. This may be seen in FIG. 9, which includes a plan view of a portion of the edgewall 15*a*. Note that while the edgewall 14*a* of the base 14 follows the outline of the edgewall 15*a*, in the illustrated embodiment the edgewall 14*a* is too short to be engaged by the blocking member 90**.

As best seen in FIG. 1, a pair of spaced apart electrically conductive wipers 96 are supported by the flange **72*a*. The wipers 96 are preferably insert molded with the flange 72*a*, or otherwise suitably fixed to the upper surface of the flange 72*a*. The wipers 96 cooperate with a conventionally formed switch pattern 97 (shown schematically in FIG. 10) fixed to the lower surface of the cover 15 to form a motor switch 98 and a lock position switch 99. The wipers 96 are preferably formed of a resilient metal to improve electrical contact with the switch pattern 97. As will be further discussed below, the lock position switch 99, being operatively connected to the output arm 70, is adapted to sense the position of the output arm 70**, and provide position indication thereof.

A final component which may be engaged by the pawl 66 within the arc of its movement is a detent arm 100. The detent arm 100 is rotatably mounted on a pin 101 which extends between the base 14 and the cover 15. The pin 101 is preferably formed integrally with the base 14, and is received in a corresponding annular boss (not shown) on the lower surface of the cover 15. The pin 101 passes through an aperture on a first end 102 of the detent arm 100. A semicircular recess 104 is formed on the lower surface of the second end 106 of the detent arm 100. A detent 108 extends laterally outward opposite to the recess 104 on the second end 106.

The detent arm 100 is capable of movement through only a limited arc. At the extreme counterclockwise limit of its movement, the detent arm 100 engages the stop 36. A spring or bumper 112 is disposed between the recess 104 of the detent arm 100 and the first backing wall 32, limiting movement in the clockwise direction. Additionally, the bumper 112 engages the edgewall **14*a* of the base 14 and the edgewall 15*a* of the cover 15. The disc-shaped bumper 112 is formed of an elastomeric material, and is provided with a central bore 114. The bumper 112 urges the detent arm 100 toward engagement with the stop 36. When driven by the pawl 66, the detent arm 100 may be rotated clockwise from the stop 36. The detent arm will then progressively compress the bumper 112 against the first backing wall 32 and the edgewalls 14*a* and 15*a*. The bumper 112 thus acts to limit the rotation of the detent arm 100 in the clockwise direction, and acts as a spring urging the detent arm 100 against the stop 36. The first backing wall 32 and the edgewalls 14*a* and 15*a* provide lateral support for the bumper 112. As will be further described, the detent arm 100 and the bumper 112 form a holding mechanism which is adapted to retain the output gear 54** in a double lock position.

Advantageously, the bumper 112 may be easily removed and installed when the cover 15 is removed. It may be desirable on occasion to use a bumper with a different spring constant than that of the bumper 112. An example where this may be desirable is when the lock actuator 13 is to be used with selected ones of a variety of latch assemblies, each having different operating characteristics. A change in spring constant may easily be accomplished by providing a substitute bumper (not shown) in place of the bumper 112.

The substitute bumper may be composed of the same elastomeric material and have the same outside diameter and thickness as the bumper 112, thus allowing it to be fitted into the existing space between the detent arm 100 and the first backing wall 32. However, providing the substitute bumper with a central bore differing from the bore 114 will give it a different spring constant than the bumper 112. Further, the diameter of the central bore may easily be measured to assure that the correct part is used. In contrast, if bumpers dimensionally similar to the bumper 112 but composed of different formulations of elastomeric material were substituted for the bumper 112 to provide a variety of spring constants, differences between the bumper 112 and the substituted bumper would not be as readily apparent.

A generally semi-circular biscuit 116 is preferably insert molded with the cover 15, or is otherwise fixed to the cover 15 within a corresponding generally semi-circular opening 118 (shown in FIG. 1) in the upper surface thereof. The biscuit 116 is preferably molded of a suitable polymeric material. A recess **116*a* is formed in the upper surface of the biscuit 116, the purpose of which will be explained below. A conventionally formed switch pattern 120 is fixed by a suitable method to the upper surface of the biscuit 116, preferably by insert molding the switch pattern 120 with the biscuit 116**.

A set of electrical connector pins 122 extend outwardly from the biscuit 116 through the edgewall **15*a* of the cover 15, and into the interior portion of the connector cover 16. The connector pins 122 are electrically connected to the switch pattern 120. The connector cover 16 provides protection against mechanical damage to the connector pins 122. The connector cover 16 similarly protects the connector pins 123 (shown schematically in FIG. 10) associated with the motor switch 98 and the lock position switch 99, as the connector pins 123 also extend into the interior of the connector cover 16. The connector pins 122 and 123 permit the control circuit for the lock actuator 13** to be easily connected to the vehicle wiring, for instance by means of a connector plug (not shown).

A depending shaft 124 is integrally formed with the lower surface of a generally semi-circular carrier 126. The shaft 124 is rotatably received in the recess **116*a* in the switch pattern 116. The carrier 126 is thus rotatable relative to the switch pattern 116**.

Figure 10:
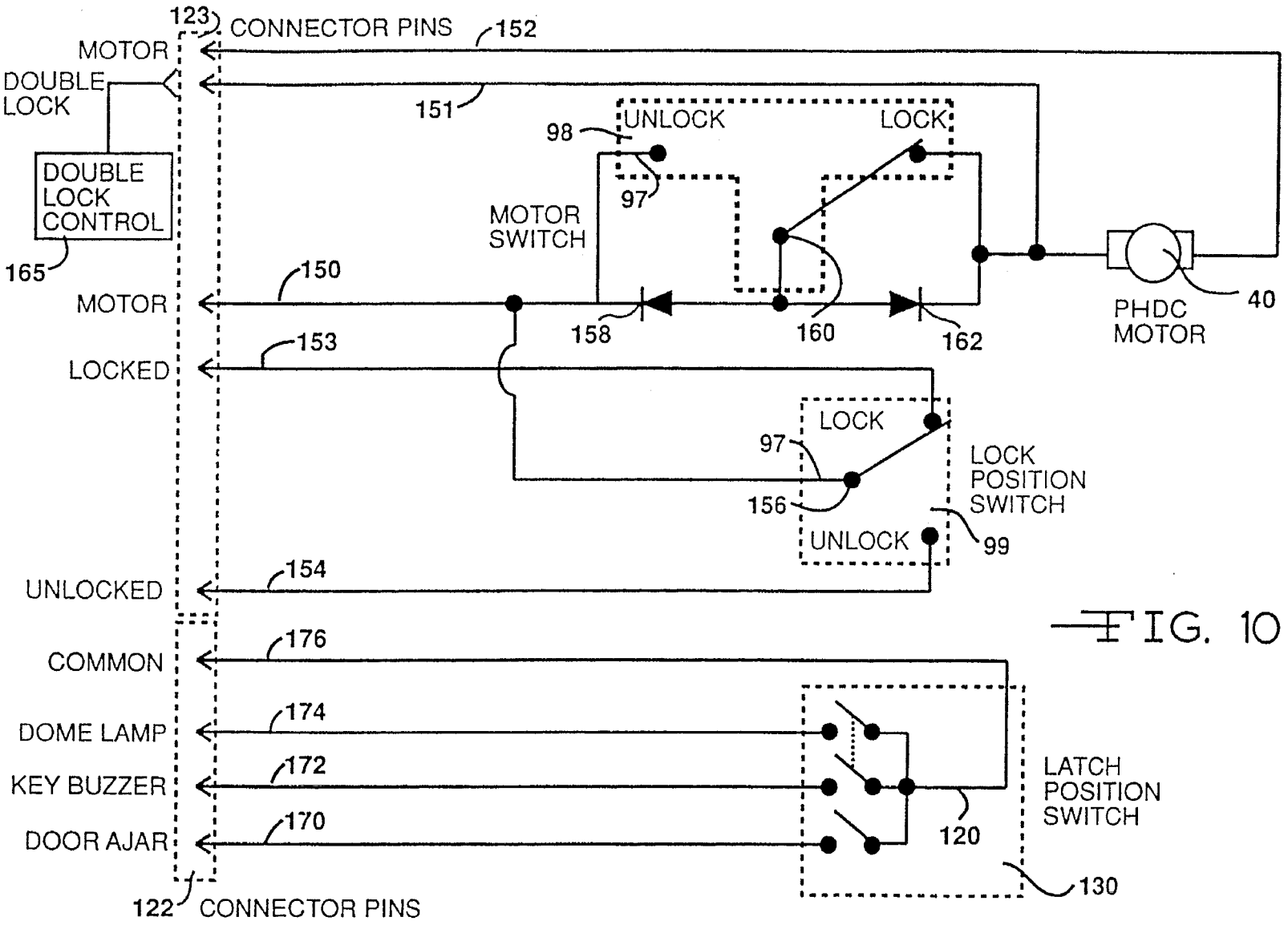
FIG. 10 is a schematic diagram of the control circuitry for the lock actuator illustrated in FIGS. 1 through 9.

An electrically conductive wiper 128 is fixed by conventional means to the lower surface (not shown) of the carrier 126, preferably by insert molding. The wiper 128 is formed as two concentric arcuate members joined along a middle portion thereof. Advantageously, the wiper 128 will be formed of a resilient metal to enhance electrical contact with the switch pattern 120. The wiper 128 cooperates with the switch pattern 120 to form (as shown in FIG. 10) a latch position switch 130. As will be further discussed below, the latch position switch 130 provides various control and indication functions.

A drive shaft 132 extends vertically out of the upper surface of the carrier 126, coaxial with the depending shaft 124. The drive shaft 132 is preferably molded integrally with the carrier 126, and includes a bearing surface 134 adjacent the carrier 126. A pair of opposed lugs 136 are formed on the radially outer surfaces of the shaft 132 above the bearing surface 134.

A generally semi-circular intermediate cover 138 includes an aperture **138*a*. The bearing surface 134 on the shaft 132 is journalled for rotation within the aperture 138*a*, and the lugs 136 on the shaft 132 extend above the intermediate cover 138. The intermediate cover 138 is formed of any suitable material such a molded polymeric material. Compressed between the intermediate cover 138 and the cover 15 is a gasket or seal 140. The seal 140** is formed of a suitable material, preferably an elastomeric material providing a leak-tight seal.

A segment gear 142 is provided with a bore **142*a* therethrough. The bore 142*a* receives the upper end of the shaft 132. A pair of opposed axially extending slots 142*b* formed in the bore 142*a* receive the lugs 136. The segment gear 142 is formed of any suitable material, such as metal or, preferably, a molded polymeric material. The segment gear 142 has teeth 144 formed in the arcuate face thereof which is engaged by a mating gear in the latch mechanism (not shown). As will be further described below, when the vehicle door (not shown) is closed, the latch mechanism operates from an unlatched to a latched position. This operation causes the gear meshing with the segment gear 142 to rotate, which drives the segment gear 142** to rotate in turn.

A support structure 146 is fixed to the surface of the cover 15 about the opening 118, except one portion thereof. The support structure 146 does not extend to the portion of the cover 15 above which the gear in the latch mechanism meshes with the segment gear 142. The support structure 146 is preferably molded integrally with the cover 15. The upper surface of the support structure 146 provides a seating surface for mounting a latch position switch cover 148. The cover 148 is formed of any suitable material, such as a metal, or preferably, a suitable polymeric material. The cover 148 is formed with a depending skirt **148*a*, which cooperates with the support structure 146 to provide lateral positioning for the cover 148. The cover 148 is secured in place on the support structure 146 by any suitable means, such as sonic welding. The cover 148 thus protects the segment gear 142. The skirt 148*a* is spaced apart from the segment gear 142 when the cover 148** is secured in place, so as not to interfere with the movement thereof.

Referring now to FIG. 4, the output gear 54 is illustrated in the neutral position. Whenever the motor 40 is deenergized, the centering spring 64 will urge the output gear 54 to the neutral position. As described above, in the neutral position the distance between the mounting post 30 and the mounting pin 62 on the output gear 54 is at a minimum. The centering spring 64 stretched therebetween is thus in its most relaxed state.

The lock mechanism (not shown) to which the lock actuator 13 is attached will typically be provided with manual means for locking and unlocking, such as a sill button or a key cylinder (neither of which is shown). When the lock mechanism is manually operated from an unlocked condition to a locked condition, the output arm 70 will be moved by the lock mechanism from the unlock position to the lock position. The output arm 70 is illustrated in FIG. 4 as being in the lock position. Similarly, when the lock mechanism is manually unlocked, the output arm 70 will be moved from the lock position to the unlock position.

With the output gear 54 in the neutral position, the pawl 66 is intermediate the drive surfaces **76*a* and 78*a* on the fingers 76 and 78**. The distance between the drive surfaces 76*a* and 78*a* is equal to or greater than the distance the output arm 70 moves between the lock and unlock positions. As indicated above, the pawl 66 and the drive surfaces 76*a* and 78*a* thereby cooperate to provide a lost motion connection between the output gear 54 and the output arm 70. This lost motion connection permits the output arm 70 to be reciprocated by the lock mechanism without driving the output gear 54. Thus the lock mechanism may be manually operated without having to drive the output gear 54, the gears 50, 46, and 42, and the motor 40. As a consequence, less force will be required to manually operate the lock mechanism.

The control circuitry for the lock actuator 13 is illustrated in FIG. 10. Conductors 150, 151, 152, 153, and 154 provided therein are connected to respective ones of the connector pins 123, and thereby connected to the vehicle lock control circuitry (not shown). The conductor 150 additionally is connected to the "unlock" contact of the motor switch 98, the common point 156 of the lock position switch 99, and a first diode 158. The first diode 158 is oriented to prevent electrical current flow from the conductor 150 to the common point 160 of the motor switch 98, and to permit current flow in the opposite direction. The conductor 151 is connected to it's respective connector pin 123, the lock position of the motor switch 98, a first connector 40*a* (FIG. 2) on the motor 40 and a second diode 162. The second diode 162 is oriented to prevent current flow from the conductor 151 to the common point 160 of the motor switch 98, and to permit current flow in the opposite direction. The conductor 152 connects the second connector 40*a* (FIG. 2) to a respective connector pin 123. Finally, the conductors 153 and 154 connect the lock position and unlock position, respectively, of the lock position switch 99 to their associated connector pins 123.

Figure 11:
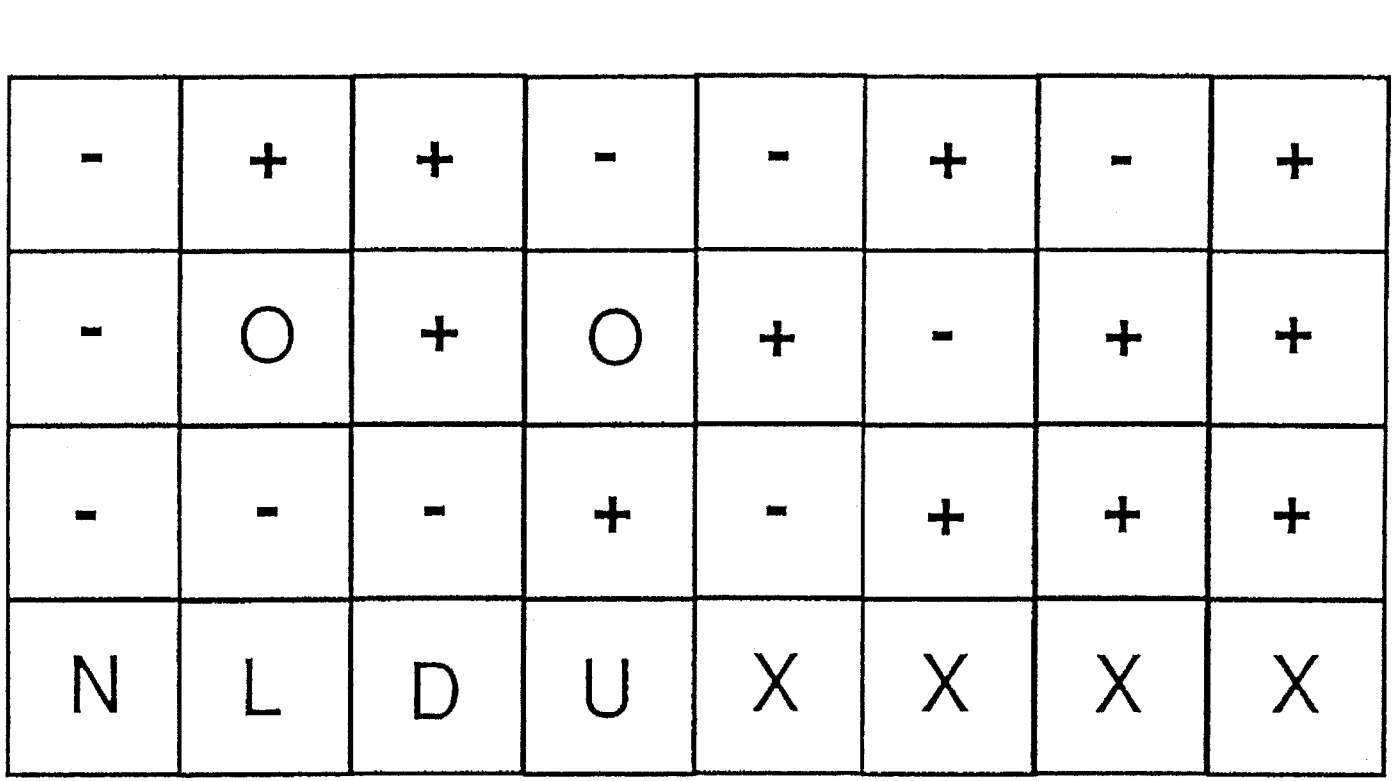
FIG. 11 is a motor control table illustrating the result of applying potentials to the control circuitry of FIG. 10.

As shown in column "N" of the table in FIG. 11, if the conductors 150, 151, and 152 are grounded (as indicated by the "–" symbol), the motor 40 will be deenergized. With the motor 40 deenergized, the output gear 54 will be urged toward the neutral position as described above and illustrated in FIG. 4. As discussed below, FIG. 11 discloses the action of the lock actuator 13 in response to various states of energization of the conductors 150, 151, and 152. The columns marked "X" are states of energization which are not defined, and the vehicle lock control circuitry should be designed to prevent the occurrence of these states of energization.

When the lock mechanism is locked, the motor switch 98 and the lock position switch 99 will be in their lock position, as indicated in FIG. 10. A circuit path is provided between the conductors 150 and 153, through the lock position switch 99, which may be utilized for indication that the lock mechanism is locked. Column "U" of FIG. 11 illustrates the condition of the conductors required to unlock the lock mechanism. The vehicle circuit to conductor 151 is open (as indicated by the "O" symbol) and the conductor 152 remains grounded. A positive voltage (as indicated by the "+" symbol) is applied to the conductor 150. The motor 40 is energized through the first diode 158 and the lock position of the motor switch 98 to drive the lock actuator 13 toward the unlock position.

The motor 40, acting through gears 42, 46, and 50, will cause the output gear 54 to rotate clockwise. The pawl 66 engages the drive surface 78*a* of the finger 78, driving the output arm 70 to the illustrated unlock position. The rotation of the output gear 54 is stopped when the pawl 66 engages the unlock bumper 68, as described above.

As the output gear 54 is rotated, the centering spring 64 is stretched, and applies an increasing force opposing the rotation, which the output gear 54 must overcome. The output gear 54 must also exert a force on the drive surface 78*a* to move the output arm 70 and the attached lock mechanism components (not shown) from the lock position to the unlock position. As noted above, the output arm 70 is guided for reciprocal movement along the axis thereof. Thus, only the component of the force exerted by the output gear 54 on the drive surface 78*a* which acts parallel to the axis of the output arm 70 acts to drive the output arm to the unlock position.

As the output gear 54 rotates, the pawl 66 moves relatively away from the output arm body 72 along the drive surface 78*a*. The line of action of the pawl 66 acting parallel with the axis of the output arm moves relatively away from the output arm 70 and toward the rotational axis of the output gear 54. Thus, the moment arm for the component of the force exerted parallel to the axis of the output arm 70 becomes shorter, and the mechanical advantage of the output gear 54 for driving the output arm 70 increases. It will be appreciated that as the output gear 54 is rotated clockwise from the neutral position to drive the output arm 70 to the lock position, a similar increase in mechanical advantage will occur. Therefore, the force applied to the lock mechanism through the output arm 70 remains relatively constant as the output arm 70 is reciprocated, and does not decrease as the centering spring 64 is elongated.

When the output arm 70 is moved from the lock position to the unlock position, the wipers 96 (FIG. 1) mounted thereon move relative to the switch pattern 97. The motor switch 98 and the lock position switch 99 are thus repositioned to their respective unlock position. Repositioning the motor switch 98 to the unlock position deenergizes the motor 40, and sets up the control circuitry for energizing the motor 40 for moving the output arm 70 to the lock position. With the motor 40 deenergized, the output gear 54 is rotated back to the neutral position by the centering spring 64.

Repositioning the lock position switch 99 to the unlock position provides a circuit path between the conductors 150 and 154, which may be utilized for indication that the lock mechanism is unlocked. Simultaneously, the circuit path between the conductors 150 and 153 is broken, removing indication that the lock mechanism is locked.

In order to lock the lock mechanism, as indicated in column "L" of FIG. 11, a positive voltage is applied to the conductor 150, and the conductor 152 is grounded. The circuit to the conductor 151 remains open. The motor 40 is energized through the second diode 162 and the unlock position of the motor switch 98. The motor 40 rotates to drive the output gear 54, through the gear train, in a clockwise direction, to the lock position shown in FIG. 6.

During rotation of the output gear 54, the pawl 66 engages the drive surface 76*a* and drives the output arm 70 to the lock position. Moving the output arm 70 to the lock position causes the motor switch 98 and the lock position switch 99 to reposition to their respective lock positions. Repositioning the lock position switch 99 provides a signal that the lock mechanism is locked, as discussed above. Repositioning the motor switch 98 deenergizes the motor 40, and sets up the control circuitry for energizing the motor 40 for moving the output arm 70 to the unlock position.

In the lock position, the pawl 66 abuts the detent 108 en the detent arm 100, which is urged into the path of the pawl 66 by the bumper 112. The cam 58 on the output gear 54 does not engage the blocking member 90 on the output arm 70. With the motor 40 deenergized by the motor switch 98, the output gear 54 does not rotate clockwise further and the pawl 66 does not drive beyond the detent 108. Therefore the centering spring 64 is able to return the output gear 54 to the neutral position, as illustrated in FIG. 4.

Finally, the lock actuator 13 may be actuated into a double lock position (illustrated in FIG. 8) by energizing the conductors 150, 151, and 152 as indicated in column "D" of FIG. 11. As indicated therein, a positive voltage is applied to the conductors 150 and 151 and the conductor 152 is grounded. The motor 40 is energized to drive the output gear 54 fully clockwise, regardless to the position of the motor switch 98. Thus the lock actuator 13 may be placed into a double lock position from either an unlock or a lock position.

As indicated above, in a double lock position, the interior sill button (not shown) will be prevented from unlocking the lock mechanism. To lessen the chance of accidently double locking the lock mechanism with someone in the vehicle, it is anticipated that the vehicle controls for the lock actuator 13 would include a double lock control 165. In order to double lock the lock mechanism, the double lock control would require actuation by a distinct secondary effort in addition to the effort required to lock the lock mechanism. For example, it is anticipated that a remote lock control transmitter may be provided with a first pushbutton switch for electrically actuating the vehicle door lock mechanisms to a lock position. In this example, the double lock control 165 may be embodied in a second pushbutton switch which must also be actuated to cause the lock mechanism to double lock. The double lock control 165 may also, for example, be embodied in a lock cylinder which requires a first turn of the associated key to lock the associated lock mechanism, and a second turn of the associated key to double lock the lock mechanism. Actuation of the double lock control 165 would result in momentary electrical energization of the conductor 151. The conductor 151 would remain energized for a time period sufficient to allow the motor 40 to place the lock actuator 13 in the double lock position, as described below.

The mechanics of the motor 40 driving the output arm 70 from the unlock position to the lock position is the same as that discussed above. Both the motor switch 98 and the lock position switch 99 move to their respective lock positions when the output arm 70 is in the lock position. However, since the motor 40 is energized through the conductor 151 as well as the conductor 150, the motor 40 is not deenergized when the motor switch 98 moves to its lock position.

Figure 7:
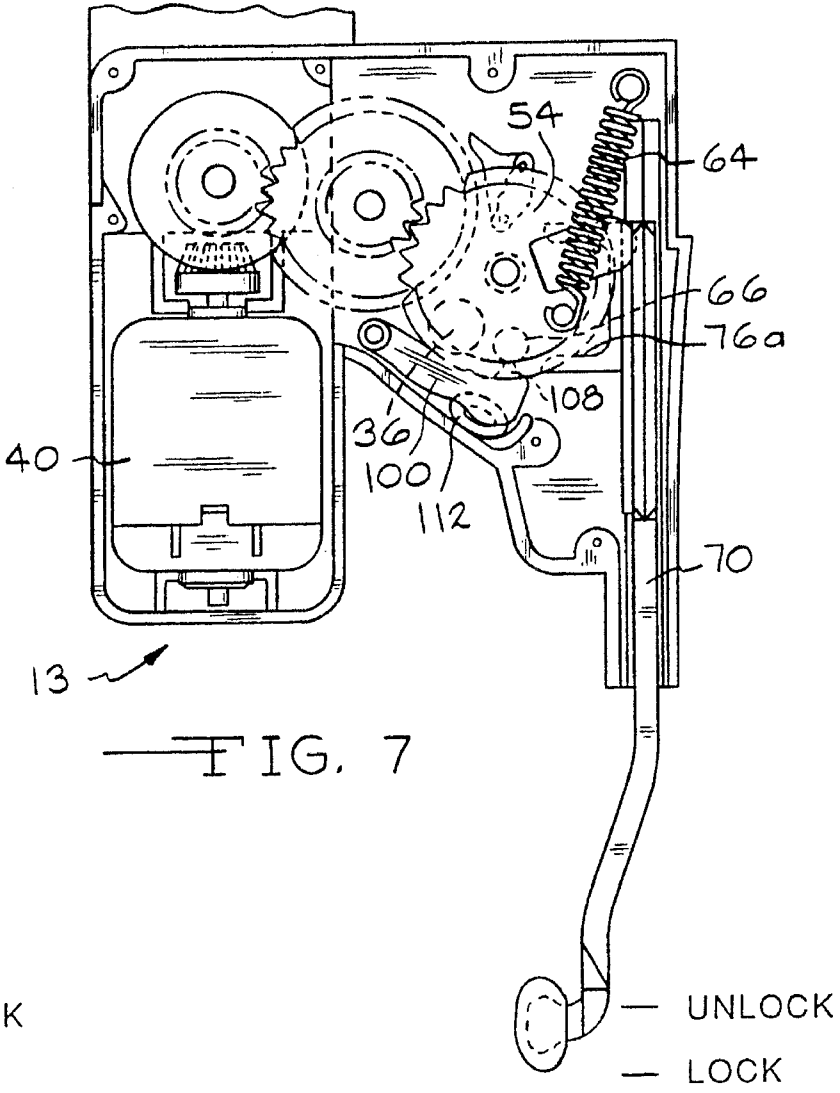
FIG. 7 is a view similar to that of FIG. 4, except illustrating the lock actuator in transition between the lock position and a double lock position.

Since the motor 40 is not deenergized when the motor switch 98 is repositioned, the output gear 54 continues to rotate clockwise. The pawl 66 rotates out of engagement with the drive surface 76*a*. The detent 108 on the detent arm 100 presents a cam surface to the pawl 66. The pawl 66 engages the cam surface of the detent 108, and causes the detent arm 100 to rotate clockwise, compressing the bumper 112 as illustrated in FIG. 7. The output gear 54 continues to rotate until the pawl 66 engages the stop block 36, as illustrated in FIG. 8. In this position, the pawl 66 no longer rides on the detent 108, and the bumper 112 urges the detent arm 100 to move counterclockwise. The detent 108 thus captures the pawl 66 against the stop block 36.

Rotating the output gear 54 to the double lock position causes the cam 58 thereon to bear against the blocking member 90 on the output arm 70. As most clearly seen in FIG. 9, the free end 94 of the blocking member 90 is deflected out of the plane of the body 72, and into the notch 95 in the edgewall 15*a*. With the blocking member 90 thus engaging the notch 95, movement of the output arm 70 from the lock position to the unlock position is prevented. Thus the output arm 70, and the lock mechanism to which it is attached, is locked by the blocking member 90 in the lock condition, and the latch mechanism is "double locked".

As indicated above, the conductor 151 is only momentarily energized. When the conductor 151 is deenergized, the motor 40 is deenergized. As shown in FIG. 8, the centering spring 64 exerts a force tending to return the output gear 54 to the neutral position. However, the detent 108 on the detent arm engages the pawl 66, retaining the output gear 54 in the double lock position. The centering spring 64 exerts insufficient force to cause the pawl 66 to cam past the detent 108, compressing the bumper 112.

In order to move the output gear 54 out of the double lock position, the motor 40 must be energized to assist the centering spring 64. The lock actuator 13 is actuated to the unlock position as described above. The control circuitry is energized as depicted in column "U" of FIG. 11. The motor 40 is energized and the output gear 54 is rotated with sufficient force that the pawl 66 cams past the detent 108. As the output gear 54 rotates counterclockwise, the cam 58 rotates out of engagement with the blocking member 90. The blocking member 90 is then free to flex out of the notch 95 and back into the body 72, freeing the output arm 70 to be moved to the unlock position when the pawl 66 subsequently rotates into engagement with the drive surface 78*a*.

It is known in the art that as a latch mechanism is latched and unlatched, a latching device such as a fork bolt moves through a range of positions. It is also known to utilize this movement to drive switches for various control and indication functions. In this invention, the motion is transmitted to the segment gear 142 as described above. Referring now to FIGS. 1, 10 and 12, the segment gear 142 is keyed to the shaft 132 by the lugs 136 engaging the slots 142*b*. The segment gear drives the carrier 126 through the shaft 132, actuating the latch position switch 130. Thus, the latch position switch 130, though mounted in the cover 15, senses the position of the latch and provides indication of the position of the latch.

Three connector pins 122 connect the latch position switch 130 to the vehicle wiring for the door ajar indication circuit, the key buzzer circuit, and the dome lamp circuit via conductors 170, 172, and 174, respectively. Additionally, one connector pin 122 connects a common power lead to the latch position switch 130 via a conductor 176.

Referring to FIG. 12, the segment gear 142 will be in position P1 when the fork bolt (not shown) is in the maximum open position. As the vehicle door is closed, and the fork bolt engages a securing pin (not shown), it will rotate, causing the segment gear 142 to rotate clockwise, moving the wiper 128 relative to the switch pattern 120, repositioning the contacts within the latch position switch 130. When the segment gear 142 reaches position P3, one set of contacts of the latch position switch 130 open to deenergize the conductor 174 (dome lamp) and the conductor 172 (key buzzer). Position P4 corresponds to the secondary latch position of the fork bolt. At position P6, the conductor 170 is deenergized (door ajar indication). Position P7 corresponds to the primary latch position of the fork bolt, and position P8 is the overslam position thereof.

When the door is unlatched, the fork bolt and the segment gear 142 reverse direction of operation. At position P5, the contacts of the latch position switch 130 close to energize the conductor 170, providing door ajar indication. At position P2, the latch position switch 130 energizes the conductors 172 and 174 to reenergize the dome lamp and the key buzzer circuits.

In accordance with the provisions of the patent statutes, the principle and mode of operation of the present invention have been explained and illustrated in its preferred embodiment. However, it must be understood that the present invention may be practiced otherwise than as specifically explained and illustrated without departing from its spirit or scope.

What is claimed is:

1. A lock actuator adapted for use with a vehicle door lock mechanism comprising:

a housing;

an output member adapted to be operatively connected to a vehicle door lock mechanism and selectively moveable relative to said housing between a first position and a second position; and a blocking member fixed to said output member which, when said output member is in said first position, can be selectively moved relative to said output member to a blocking position engaging said housing such that movement of said output member to said second position is prevented.

2. The lock actuator of claim 1 further including a rotatable member having a cam surface formed thereon, said rotatable member being selectively rotatable between a disengaged position and an engaged position in which said cam surface engages said blocking member and urges said blocking member into said blocking position.

3. The lock actuator of claim 1 wherein said housing includes an engagement surface defined thereon, and wherein said output member and said blocking member cooperate to define a generally C-shaped slot through said output member, said blocking member being integrally formed with said output member as a tongue fixed at one end to said output member, said blocking member having a portion thereof which may be urged into engagement with said engagement surface defined on said housing, said blocking member and said engagement surface cooperating when in engagement to block movement of said output member from said first position toward said second position.

4. A lock actuator adapted for use with a lock mechanism for a latch assembly having a latch, said lock mechanism having a locked position and an unlocked position, the lock actuator comprising:

a housing;

an output member mounted at least partially within said housing for connecting said lock actuator to said lock mechanism to move said lock mechanism between said locked and unlocked positions;

a lock position indicator mounted within said housing, said lock position indicator including electrical contacts connected to said output member to continuously sense the position of said output member; and a latch position indicator mounted within said housing, said latch position indicator being operatively connected to said door latch assembly to sense the position of said latch.

5. A lock actuator adapted for use with a lock mechanism for a vehicle latch assembly, the lock actuator comprising:

an output arm adapted for coupling to a lock mechanism and linearly moveable between a lock position, in which the latch assembly is locked, and an unlock position, in which the latch assembly is unlocked, said output arm including a pair of spaced apart opposed drive surfaces;

an output gear having a pawl formed thereon, said output gear being selectively rotatable about an axis in a first direction to cause said pawl to engage a first one of said drive surfaces to urge said output arm to said lock position, said output gear being selectively rotatable about said axis in a second direction to cause said pawl to engage the other of said drive surfaces to urge said output arm to said unlock position;

a lock actuator housing;

a lock position indicator mounted within said lock actuator housing and sensing the position of said output arm; and a latch position indicator mounted within said lock actuator housing, said latch position indicator being operatively coupled to said latch assembly and sensing the position of said latch assembly.

6. The lock actuator of claim 5 wherein said output gear is adapted to be rotated to a neutral position wherein said pawl is intermediate of and spaced apart from said pair of drive surfaces.

7. The lock actuator of claim 6 including a first spring engaging said output gear, said first spring acting to urge said output gear toward said neutral position.

8. The lock actuator of claim 5 wherein said pair of drive surfaces are formed by a pair of spaced apart fingers extending laterally outward from said output arm.

9. The lock actuator of claim 8 wherein said pawl defines a diameter and said spaced apart fingers define a distance therebetween which is greater than said diameter defined by said pawl.

10. A lock actuator adapted for use with a lock mechanism for a vehicle latch assembly, the lock actuator comprising:

a housing in which at least a portion of said lock actuator is operatively mounted, said housing having a latching surface;

an output arm adapted for coupling to a lock mechanism, said output arm being axially moveable relative to said housing between a lock position, in which the latch assembly is locked, and an unlock position, in which the latch assembly is unlocked, said output arm including a pair of spaced apart opposed drive surfaces;

a blocking member operatively connected to said output arm, said blocking member operable when said output arm is in said lock position to move between a neutral position and a blocking position, said blocking member engaging said latching surface of said housing in said blocking position to prevent movement of said output arm from said lock position to said unlock position; and an output gear having a pawl formed thereon, said output gear being selectively rotatable about an axis in a first direction to cause said pawl to engage a first one of said drive surfaces to urge said output arm to said lock position, said output gear being selectively rotatable about said axis in a second direction to cause said pawl to engage the other of said drive surfaces to urge said output arm to said unlock position.

11. The lock actuator of claim 10, wherein said output gear is moveable to a double lock position, said output gear having a cam formed thereon which is adapted to engage said blocking member when said output gear is in said double lock position to urge said blocking member into said blocking position.

12. The lock actuator of claim 11, wherein said output gear is rotatable to said double lock position.

13. The lock actuator of claim 11, including a holding mechanism adapted to retain said output gear in said double lock position.

14. The lock actuator of claim 13, said holding mechanism including a holding member adapted to engage said output gear and a holding spring urging said holding member into engagement with said output gear when said output gear is in said double lock position.

15. The lock actuator of claim 13 wherein said holding spring is an elastomeric ring.

16. The lock actuator of claim 14, wherein said output gear is adapted to be rotated to a neutral position wherein said pawl is between and spaced apart from said pair of drive surfaces, and further including a centering spring engaging said output gear, said centering spring acting to urge said output gear toward said neutral position.

17. A lock actuator adapted for use with a lock mechanism for a vehicle latch assembly, the lock actuator comprising:

an output arm adapted for coupling to a lock mechanism, guided for reciprocal movement and linearly moveable between a lock position, in which the latch assembly is locked, and an unlock position, in which the latch assembly is unlocked, said output arm including a pair of spaced apart opposed drive surfaces; and an output gear having a pawl formed thereon, said output gear being selectively rotatable about an axis between unlocked, neutral, locked, and double locked positions, said pawl cooperating with said pair of drive surfaces to provide a lost motion connection between said output gear and said output arm, said output gear rotatable in a first direction to cause said pawl to engage a first one of said drive surfaces to urge said output arm to said lock position, said output gear being selectively rotatable about said axis in a second direction to cause said pawl to engage the other of said drive surfaces to urge said output arm to said unlock position.

18. The lock actuator of claim 17 wherein said output gear is rotatable in a plane and said pawl extends perpendicularly to said plane.

19. The lock actuator of claim 17, said lost motion connection characterized by an increase in a mechanical advantage of said output gear in driving said output arm as said output gear is rotated from said neutral position to said unlock position and from said neutral position to said lock position.

* * * * *

UNITED STATES PATENT AND TRADEMARK OFFICE

CERTIFICATE OF CORRECTION

PATENT NO. : 5,503,441

DATED : April 2, 1996

INVENTOR(S) : Dennis D. Schwaiger

It is certified that error appears in the above-indentified patent and that said Letters Patent is hereby corrected as shown below:

Column 15, Claim 15, Line 1, after "claim", change "13" to -- 14 --.

Signed and Sealed this

Thirty-first Day of December, 1996

*Attest:*

Bruce Lehman

BRUCE LEHMAN

*Attesting Officer*

*Commissioner of Patents and Trademarks*